United States Patent [19]

Kuna

[11] Patent Number: 4,874,166

[45] Date of Patent: Oct. 17, 1989

[54] SKILL ACTION GAME WITH A TILTABLE HOUSING AND AN ALARM PRODUCING DISTURBANCE SENSOR

[75] Inventor: Wayne A. Kuna, River Forest, Ill.

[73] Assignee: Marvin Glass & Associates, Chicago, Ill.

[21] Appl. No.: 296,988

[22] Filed: Jan. 17, 1989

[51] Int. Cl.[4] ..... A63F 9/00

[52] U.S. Cl. ..... 273/1 GC; 273/199

[58] Field of Search ..... 273/1 GC, 1 GF, 1 GG; 340/541, 571

[56] References Cited

U.S. PATENT DOCUMENTS

| | | | |
|---|---|---|---|
| 2,458,306 | 1/1949 | Schneider | 273/1 GF |
| 2,985,451 | 5/1961 | Sims | 273/1 GF |
| 3,158,370 | 11/1964 | Pearson | 273/1 GC |
| 3,565,426 | 2/1971 | Goldfarb et al. | 273/1 GC |
| 3,687,451 | 8/1972 | Breslow | 273/1 GG |
| 3,706,867 | 12/1972 | Rand et al. | 340/541 X |
| 3,721,956 | 3/1973 | Hamann et al. | 340/571 X |
| 3,755,778 | 8/1973 | Kennedy | 340/571 X |
| 3,857,569 | 12/1974 | Goldfarb et al. | 273/1 GG |

*Primary Examiner*—Paul E. Shapiro

*Attorney, Agent, or Firm*—John S. Pacocha

[57] ABSTRACT

A skill action game includes a hollow foot that is balanced on the rounded heel and ball when placed on a flat surface. The foot has a number of threaded bolts removably inserted into it and a wrench is provided for removing the bolts. Inside the foot is a vibration and sound producing system powered by an electric motor. Activation of the motor is controlled by tilt switch. If, during the course of removing a bolt, a player dusturbs the balance of the foot, the motor is activated producing a sound and causing the foot to vibrate.

18 Claims, 1 Drawing Sheet

SKILL ACTION GAME WITH A TILTABLE HOUSING AND AN ALARM PRODUCING DISTURBANCE SENSOR

BACKGROUND OF THE INVENTION

1. Field of the Invention

This invention relates generally to games and more particularly to skill action games.

2. Background Art

Skill action games in which players attempt to remove items without causing a disturbance are old in the art. Pick Up Sticks is an example of an old prior art game in which players attempt to remove one or more sticks from the pile without causing the pile to move. U.S. Pat. No. 3,333,846 issued Aug. 1, 1967 to Glass et al. discloses a game in which players insert an electrically conductive probe in an opening between electrically conductive plates; an electrically powered signal device is activated if the player contacts the plates with the probe. The Milton Bradley Company Operation game utilizing tweezers for the removal of comic body parts is similar in principle to the game disclosed in U.S. Pat. No. 3,333,846. Ideal Toy Corporation had a Beware The Spider game in which players tried to remove plastic critters from a metal web using an electrically connected metal fork; if the fork touched the web, a spider would be propelled from its perch. Cadaco, a division of Rapid Mounting and Finishing Company, has a Flap'N Chicken game in which players insert a probe electrically connected to the chicken into a magnetic nest in front of the chicken attempting to remove eggs; if the probe touches the sides of the magnetic nest, the chicken makes a noise and flaps its wings. However, there remains a need for additional entertaining skill action games in which players try to collect items without causing a disruption.

SUMMARY OF THE INVENTION

The present invention is concerned with providing a skill action game in which players attempt to remove threaded bolts from a tiltable Frankenstein-like foot without activating a sound and motion alarm. Contained within the foot are a battery powered motor that drives both an eccentric and a gear engaging a reed to vibrate the foot and cause sound. Movement of the foot sufficient to activate the motor is sensed by a ball in cup in which contacts a ring to close the circuit.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figures 1, 2, 3, 4, 5, 6, 7:
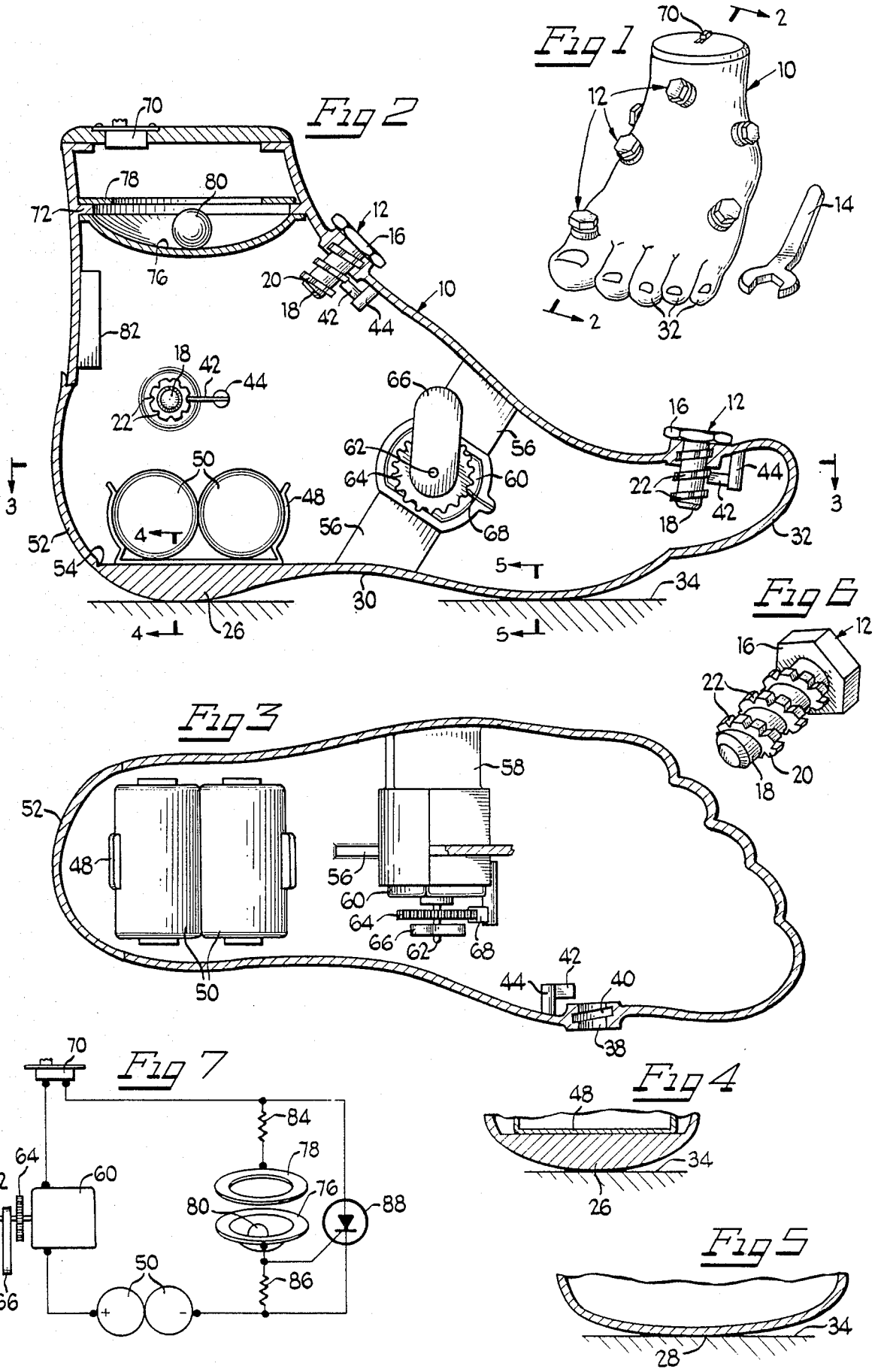
FIG. 1 is a perspective view of an embodiment of the present invention.
FIG. 2 is an enlarged scale, sectional view taken generally along line 2—2 of FIG. 1.
FIG. 3 is a sectional view taken generally along line 3—3 of FIG. 2.
FIG. 4 is a fragmentary sectional view taken generally along line 4—4 of FIG. 2.
FIG. 5 is a fragmentary sectional view taken generally along line 5—5 of FIG. 2.
FIG. 6 is an enlarged scale, perspective view of one part of the embodiment.
FIG. 7 is a schematic diagram of the electrical circuit.

Referring now to the drawings in which like parts are designated by like reference numerals throughout the several views, FIG. 1 shows a large, hollow, Frankenstein-like foot 10 into which a number of threaded bolts 12 are removably inserted. A wrench 14 is provided for removal of the bolts. Each bolt 12 has a hexagonal head 16 on one end of a stem 18 that has a raised spiral thread 20. Spaced along the length of spiral thread 20 are notches 22.

The bottom of foot 10 is formed with a curved heel 26 and a curved ball 28 that lie below the arch 30 and upturned toes 32. When the bottom of foot 10 is placed upon a substantially planar surface 34, it rests upon the lower most points of heel 26 and ball 28. Since foot 10 is essentially only supported on two points, it is unstable on a substantially planar surface and will rock from side to side about a longitudinall axis extending generally from toes to heel.

There are a number of openings 38 in various locations on the upper and side surfaces of foot 10. Each opening 38 has a spiral groove 40 which receives a thread 20 so that a bolt 12 may be threaded into and out of the opening.

Adjacent the inside end of each opening 38 is a reed 42 mounted on a post 44 secured to the inside of foot 10. Reed 42 extends beyond the adjacent edge of groove 40 so that the reed engages the outer surface of thread 20 and drops into notches 22 as the bolt is turned to provide a clicking sound.

Secured to the inside of hollow foot 10 is a clip 48 containing batteries 50. Foot 10 has a lower back vertical wall 52 that opens outwardly and downwardly about a living hinge 54 to provide access to the interior of foot 10 for changing batteries 50 as needed. Extending from the inside of the bottom wall forming the arch of the foot up to the inside of the upper wall forming the instep of the foot is an angled column 56 which, together with lateral beam 58 extending in from the sidewall of the foot, provides a mounting for motor 60. Secured on an output shaft 62 of motor 60, for rotation with the output shaft, are a toothed gear 64 and an eccentric weight 66. A flexible sound producing reed 68 is carried by the motor mount in engagement with the teeth of gear 64.

On top of the ankle portion of foot 10 is an on/off slide switch 70. Inside of the foot, adjacent the ankle portion, is an inwardly directed flange 72. Secured to the bottom of flange 72 is a conductive cup 76 and a conductive ring 78 is secured on the top of flange 72. Disposed in cup 76 is a conductive ball 80. Cup 76, ring 78 and ball 80 cooperate to form a tilt switch.

Also contained in foot 10 is a circuit board 82 which includes resistors 84 and 86 plus silicon controlled rectifier 88. Once ball 80, as a result of the rocking of foot 10, contacts ring 78, motor 60 will be turned on as long as slide switch 70 is in the closed, on position. As indicated in the schematic diagram of FIG. 7, when ball 80, which stays in cup 76 and is in electrical contact with cup 76, also comes into electrical contact with ring 78, SCR 88 will be turned on by current flow from resistor 84 into the gate of the SCR. Even after ball 80 breaks contact with ring 78, motor 60 will be kept on by SCR 88 until slide switch 70 is moved to the open, off position.

To play the game, a number of players take turns attempting to remove bolts 12 from foot 10 using wrench 14 without tiltiing the foot. Upon successfully removing the bolt, the player may elect to pass the wrench on to the next player or attempt to remove additional bolts. If, while removing a bolt, a player tilts the foot activating the sound and motion alarm, the player's turn is over; all bolts removed during that turn are lost and the player must screw the bolt being removed back in and pass the wrench on to the next player.

While a particular embodiment of the present invention has been shown and described, variations and modifications will occur to those skilled in the art. It is intended in the appended claims to cover all such variations and modifications as fall within the true spirit and scope of the present invention.

What is claimed as new and desired to be secured by Letters Patent is:

1. A skill action game comprising in combination:
a housing;
the housing having a bottom;
a curved surface depending from the bottom such that the housing is not stable when placed upon a substantially planar surface;
a plurality of items removably carried by the housing;
means sensing tilting of the housing relative to the substantially planar surface; and
an alarm activated by the sensing means.

2. The game of claim 1 including another curved surface depending from the bottom and spaced apart from the other curved surface.

3. The game of claim 2 including a tool for removing the items.

4. The game of claim 2 in which the alarm includes an electrical circuit inside of the housing.

5. The game of claim 4 in which:
the means sensing tilting of the housing includes a momentary on/off tilt switch;
the momentary tilt switch is normally off until tilting the housing turns the momentary switch on; and
a silicone control rectifier in the circuit keeps the circuit on even after the momentary switch turns off.

6. The game of claim 4 in which the alarm includes an electric motor driving an eccentric weight to vibrate the housing.

7. The game of claim 6 including:
a toothed gear driven by the motor; and
a sound producing reed engaged by the toothed gear.

8. The game of claim 4 including:
a toothed gear driven by the motor; and
a sound producing reed engaged by the toothed gear.

9. The game of claim 2 in which the plurality of items comprise threaded bolts.

10. The game of claim 9 in which:
the threaded bolts each have a spiral thread having a plurality of spaced apart notches; and
a sound producing flexible reed carried by the housing is in engagement with the threads to produce a sound as the bolts are turned.

11. The game of claim 1 including a tool for removing the items.

12. The game of claim 1 in which the alarm includes an electrical circuit inside of the housing.

13. The game of claim 12 in which:
the means sensing tilting of the housing includes a momentary on/off tilt switch;
the momentary tilt switch is normally off until tilting the housing turns the momentary switch on; and
a silicone control rectifier in the circuit keeps the circuit on even after the momentary switch turns off.

14. The game of claim 12 in which the alarm includes an electric motor driving an eccentric weight to vibrate the housing.

15. The game of claim 14 including:
a toothed gear driven by the motor; and
a sound producing reed engaged by the toothed gear.

16. The game of claim 12 including:
a toothed gear driven by the motor; and
a sound producing reed engaged by the toothed gear.

17. The game of claim 1 in which the plurality of items comprise threaded bolts.

18. The game of claim 17 in which:
the threaded bolts each have a spiral thread having a plurality of spaced apart notches; and
a sound producing flexible read carried by the housing is in engagement with the threads to produce a sound as the bolts are turned.

* * * * *